United States Patent [19]

Scott

[11] Patent Number: 4,878,560

[45] Date of Patent: Nov. 7, 1989

[54] EARMOLD

[76] Inventor: Robert T. Scott, 416 Lighthouse Ave., Santa Cruz, Calif. 95060

[21] Appl. No.: 323,994

[22] Filed: Mar. 16, 1989

[51] Int. Cl.[4] ..... H04R 25/00

[52] U.S. Cl. ..... 181/130; 181/135; 381/68.6; 381/69

[58] Field of Search ..... 181/129, 130, 135; 381/68.6, 69; 128/864

[56] References Cited

U.S. PATENT DOCUMENTS

| | | | |
|---|---|---|---|
| 3,131,241 | 4/1964 | Mendelson | 181/135 X |
| 3,702,123 | 11/1972 | Macken et al. | 181/135 |
| 3,763,334 | 9/1956 | Starkey | 181/135 |
| 4,223,189 | 9/1980 | Warren | 181/135 X |
| 4,537,187 | 8/1985 | Scott | 128/864 |

*Primary Examiner*—B. R. Fuller

[57] ABSTRACT

An integrally formed earmold is provided which supports a headset or stethoscope, for example, without requiring either a headband or arms extending into the ear canal. The earmold is formed from a soft, flexible elastic plastic and has an inwardly extending conical portion adapted to fit into the concha and outer portion of the auditory canal, terminating in a rectangular knob with a small flange thereon, the knob sealing off the meatus of the external ear canal without substantially penetrating the external ear canal. A hollow cylinder extends laterally from the knob a sufficient distance to form a support for a headset or the like. The earmold is sufficiently flexible that standard sizes will fit the general population, without requiring molds formed for particular users.

6 Claims, 1 Drawing Sheet

EARMOLD

SUMMARY OF THE INVENTION

The present invention relates generally to an earmold which is capable of supporting radio or telephone headsets, hearing aids and stethoscopes. The present invention represents an improvement over my U.S. Pat. No. 4,537,187.

Whereas my earlier patent related to an earplug, the present invention relates to a modification of my earlier earplug design which allows the improved device to be used as a support for headsets and the like without requiring the use of either a headband or arms extending substantially into the external ear canal. The earmold of the present invention also includes a conical portion having a radius of curvature slightly larger than the radius of curvature of the user's concha. This feature produces a constant extending of the earmold against the user's concha, which increases the overall supporting capability of the device.

A primary object of the earmold is to provide a device capable of supporting headsets, hearing aids and stethoscopes without substantially penetrating the external ear canal and without requiring headbands.

A further object of the invention is to provide an earmold of such a simple design which in several standard sizes is capable of fitting virtually any normal ear.

A further object of the invention is to provide an earmold which can be used in either the right or left ear of the user.

A still further object of the invention is to provide an earmold of such a flexible and relatively simple design that custom casting of an earmold for a particular user is not required.

Various other objects and features of the invention will be brought out in the balance of the application.

DETAILED DESCRIPTION OF THE PREFERRED EMBODIMENT

Figure 1:
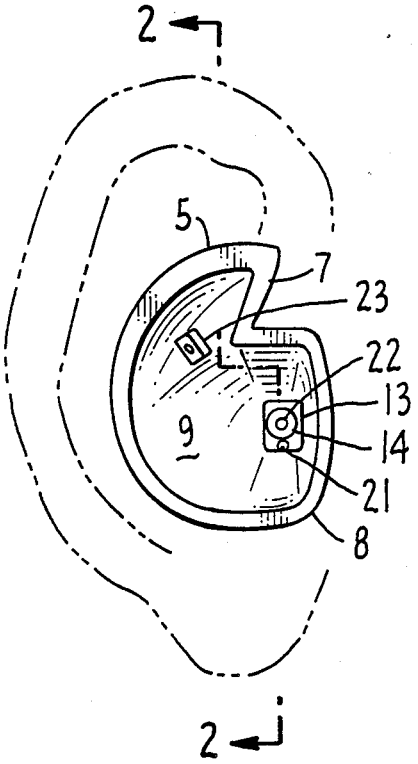
FIG. 1 is a side elevation of an earmold according to the present invention.
Figure 2:
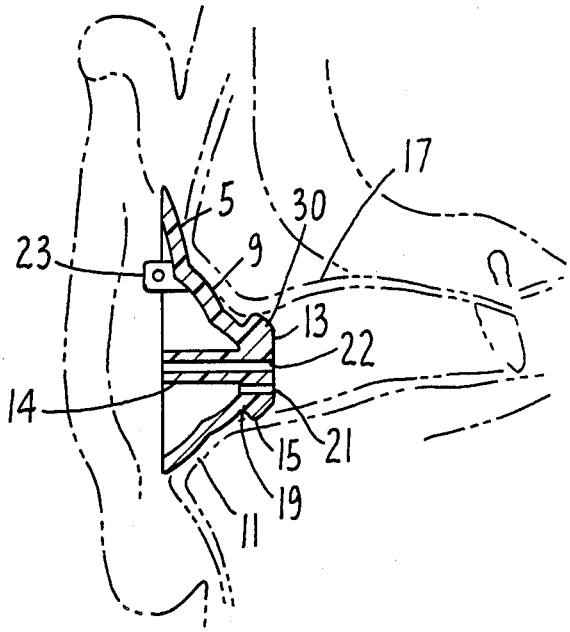
FIG. 2 is a section on the line 2—2 of FIG. 1.
Figure 3:
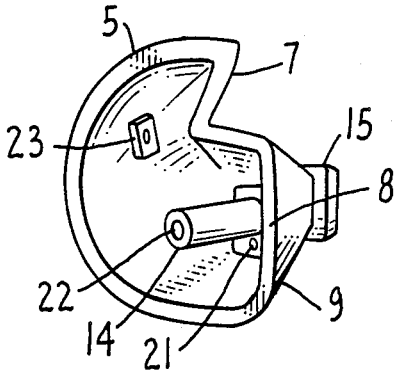
FIG. 3 is a front perspective of the earmold according to the present invention.
Figure 4:
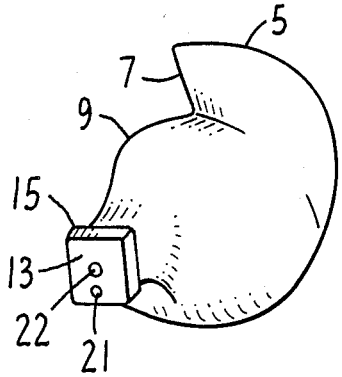
FIG. 4 is a rear perspective view of the earmold of the present invention.

The earmold of the present invention is shown in solid lines while the ear of the user is shown in phantom. The earmold of the present invention has an optional external flange 5 extending against the pinna and with a side 7 adapted to fit against the crus helix and with a side 8 adapted to fit against the tragus. The earmold had a conical portion 9 which is concave in an outward direction from the user's ear adapted to fit against the cavum concha 11. In the preferred embodiment, the radius of curvature of conical portion 9 of the earmold is selected to be approximately 2–5% greater than the radius of curvature of the user's cavum concha 11. Since the earmold is constructed of a relatively soft and flexible elastic plastic, such as styrene-rubber copolymer of softness of about 42A, the earmold does have a memory and will tend to extend in a direction to achieve its at rest radius of curvature. By selecting a radius of curvature of conical portion 9, which slightly exceeds the radius of curvature of the user's cavum concha, in use, the earmold will exert a constant mild extending against the cavum concha of the user, which, in effect, increases the ability of the earmold to support headsets and the like.

The inner end of the earmold forms a knob 30 having a flat portion 13 forming the innermost surface of the earmold. A small external flange 15 extends around the periphery of knob 30 and fits into the auditory canal 17 and tends to grip the side of the auditory canal as shown at 19, thereby in effect anchoring the earmold at the entrance of the external ear canal.

A hollow cylinder 14 extends laterally from knob 30 outwardly a sufficient distance to form a support for a headset or the like. For example, hollow cylinder 14 may extend approximately ¼ inch outwardly to support radio and telephone headsets. The headsets may be supported either by sliding over the outer diameter of cylinder 14 or, alternatively, may be supported by smaller tubular members carried within the internal diameter of hollow cylinder 14. The preferred design includes an inner diameter of hollow cylinder 14 of at least 0.060 inches with the supporting member for the headset extending over the outer diameter of cylinder 14.

A vent passage 21 is formed which extends through knob 30. The preferred inner diameter of vent 21 is at least 0.050 inches which provides sufficient aeration of the auditory canal. The vent 21 also improves sonic comfort and equalizes air pressures on either side of the earmold.

An optional tab 23 is used in those instances where the earmold preferably is secured with a leash or so that the earmold can be removed by pulling on the tab. Alternatively, tab 23 can be used to provide further support for a radio or telephone hadset or other instrument supported by the earmold.

The preferred plastic used for this earmold is a styrene-rubber copolymer sold under the trade name KRATON G2712X having a durometer softness of 42A. However, the earmold can be made of other plastic so long as the plastic is light enough to float and soft enough to be comfortable to the wearer.

Figure 5:
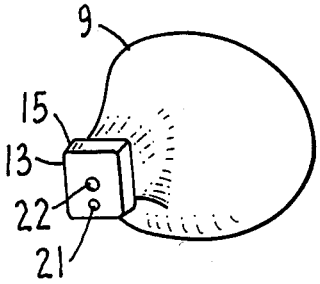
FIG. 5 is a rear perspective view of an alternate embodiment of the invention.

The alternate embodiment shown in FIG. 5 is formed without the external flange 5 and may be used in either the right or left ear of the user.

The earmold according to this invention avoids the previous requirement of having to custom-form an earmold for each particular user. The present earmold is made in six different standard sizes, which will fit approximately 95% of normal ears. This feature is made possible by the relative flexibility of the earmold. The flexibility also helps keep the earmold in position during normal activities of the user.

I claim:

1. An integrally formed earmold having thin walls and having an inwardly extending conical portion adapted to fit into a concha and outer portion of an auditory canal, terminating in a rectangular knob with a small flange thereon, said knob sealing off a meatus of an external ear canal without substantially penetrating the external ear canal, said flange anchoring an earmold at the entrance of the external ear canal, and a hollow cylinder extending laterally from said knob a sufficient distance to form a support for a headset, said integrally formed earmold being made of a soft, flexible, elastic plastic.

2. The integrally formed earmold of claim 1 wherein a radius of curvature of said inwardly extending conical portion exceeds a radius of curvature of the concha of a user by approximately 2–5%, whereby the earmold tends to extend against the concha of the user in use.

3. The integrally formed earmold of claim 1 made of a styrene-rubber copolymer having a durometer softness of about 42A.

4. The integrally formed earmold of claim 1 further comprising an external flange adapted to engage a crus helix of an ear of a user.

5. The integrally formed earmold of claim 1 wherein said hollow cylinder has an internal diameter of at least 0.060 inches.

6. The integrally formed earmold of claim 1 further comprising a vent passageway extending through said knob.

* * * * *